United States Patent [19]

Fujimoto et al.

[11] 4,401,090

[45] Aug. 30, 1983

[54] INTERNAL COMBUSTION ENGINE WITH HEATED INTAKE SYSTEM

[75] Inventors: Hiroaki Fujimoto; Kyoji Hakamata, both of Hamamatsu, Japan

[73] Assignee: Yamaha Hatsudoki Kabushiki Kaisha, Iwata, Japan

[21] Appl. No.: 249,144

[22] Filed: Mar. 30, 1981

[30] Foreign Application Priority Data

Apr. 4, 1980 [JP] Japan ..... 55-44339

[51] Int. Cl.[3] ..... F02M 31/00

[52] U.S. Cl. ..... 123/545; 123/549

[58] Field of Search ..... 123/545, 549

[56] References Cited

U.S. PATENT DOCUMENTS 1,567,304 12/1925 Smith ..... 123/549 X
1,844,298 2/1932 Rogers ..... 123/549 X
4,256,066 3/1981 Serruys ..... 123/545
4,286,564 9/1981 Van Tuyl ..... 123/545
4,302,407 11/1981 Hartel et al. ..... 123/549

FOREIGN PATENT DOCUMENTS 54-75637 6/1979 Japan ..... 123/549

*Primary Examiner*—Wendell E. Burns
*Attorney, Agent, or Firm*—Donald D. Mon

[57] ABSTRACT

An internal combustion engine subject to low-temperature operation in humid regions is provided with means to heat the carburetor so as to prevent icing and excessive condensation of fuel from the fuel/air charge. The heat is preferably supplied to the wall of the intake passage just downstream from the throttle valve, and may be derived from engine coolant, engine gas exhaust, or from a separately-powered heater.

8 Claims, 8 Drawing Figures

INTERNAL COMBUSTION ENGINE WITH HEATED INTAKE SYSTEM

FIELD OF THE INVENTION

The present invention relates to an intake system heating system for an internal combustion engine, which is intended to prevent a carburetor from icing when the ambient temperature is low, and to promote the atomization of fuel under low-temperature conditions.

BACKGROUND OF THE INVENTION

An outboard engine, for example, is directly exposed to very humid ambient air. Because the humid ambient air is at a low temperature when the ambient temperature is low, moisture in the intake air ices in the vicinity of the throttle valve of a carburetor so that the operation of the throttle valve is degraded, or so that the fuel and air passages of the slow system of the carburetor ice up and thereby frustrate smooth engine running. These are called "the icing phenomena", and are encountered especially when the ambient air temperature is low. Also, if the temperatures of the carburetor and/or of the intake passage that provides communication between the carburetor and the engine are low, the atomization of the fuel is degraded. The atomized fuel in the fuel/air charge is again condensed and separates to wet the inner wall of the intake passage, thus making the air-fuel ratio leaner. Therefore, an outboard engine having specifications especially designed for a cold country conventionally has its carburetor adjusted to feed a rich mixture to the cylinders, but this adjustment wastes fuel and raises the fuel consumption rate.

Objects of this invention are to prevent the carburetor icing and/or to promote the atomization of the fuel.

BRIEF DESCRIPTION OF THE INVENTION

The present invention is characterized in that an intake passage member is interposed between an engine cylinder and a carburetor which is provided with both an intake port for providing communication between the cylinder and the carburetor-thereby to construct an intake passage, and a chamber surrounding that intake port. The temperature of the aforementioned intake passage is raised either by introducing a heat medium, which has been heated in another portion (for examples, engine coolant or engine exhaust gases) into that chamber, or by directly heating some heat medium which is contained in that chamber.

According to a preferred but optional feature of the invention, the cooling water for cooling the cylinder is used as the aforementioned heat medium, so that the cooling water which has cooled the cylinder and thereby become heated is introduced into the aforementioned heating chamber so that it circulates therein and heats the intake passage.

According to another optional feature of the invention, the engine exhaust gas is used as the heat medium.

According to yet another feature of the invention, a heat medium (such as water or oil), is filled in the aforementioned chamber, and is heated by means of a heater in that chamber.

The above and other features of this invention will be fully understood from the following detailed description and the accompanying drawings, in which:

DETAILED DESCRIPTION OF THE INVENTION

Figure 1:
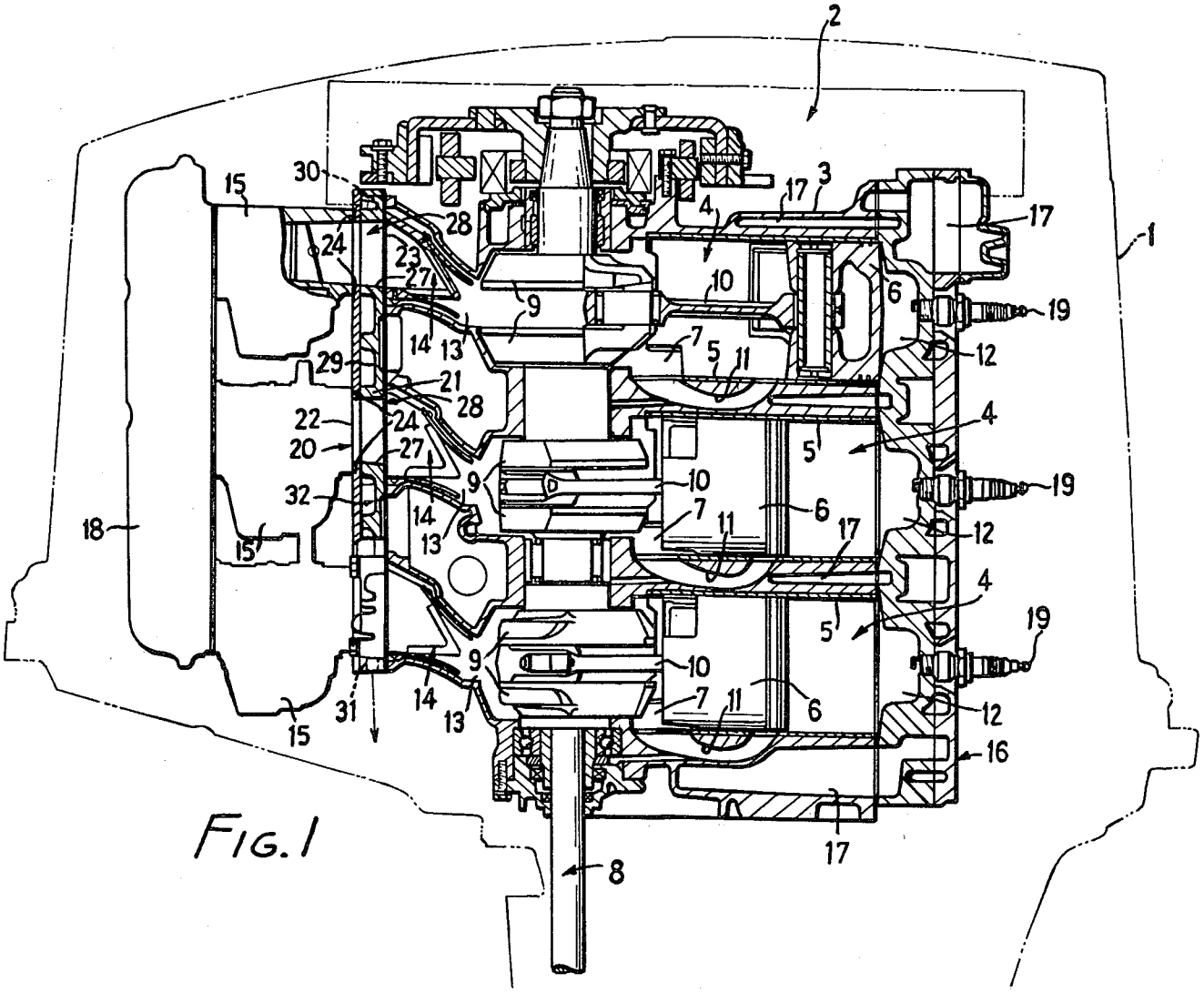
FIG. 1 is a side view, partly in cutaway cross-section, showing the presently preferred embodiment of the invention.

A cowling of an outboard engine as shown in FIG. 1, inside which a two stroke-cycle, three cylinder engine 2 is mounted. Engine 2 has three cylinders 4 stacked in a cylinder block 3 such that their center lines extend substantially horizontally. In the inner walls of the respective cylinders 4, there are mounted a respective sleeve 5, in which a respective piston 6, is slidably received. Respective cylinders 4, communicate with crank cases 7, in which crank arms 9 of a crank shaft 8 are accommodated. Crankshaft 8 is vertically oriented. Crank arm 9 connected to a respective piston 6 by a respective connecting rod 10. The lower end of crank shaft 8 extends downwardly to where it is connected to a propeller (not shown). The aforementioned respective crank cases 7 form primary compression chambers acting as scavenging chambers, and communicate with respective combustion chambers 12, through respective scavenging passages 11 that are provided in the walls of cylinders 4. Each passage 13 leading to its respective crank case 7 is connected with a respective carburetor 15 through a respective reed valve 14. Each cylinder 4 and a cylinder head 16 is enclosed by a water jacket 17 that they are cooled by cooling water which is made to circulate in water jackets 17. In this instance, the cooling water is pumped up from below the water surface by the action of a water pump (not shown). Incidentally, numeral 18 indicates an intake silencer, and numerals 19 indicate ignition plugs.

Figure 2:
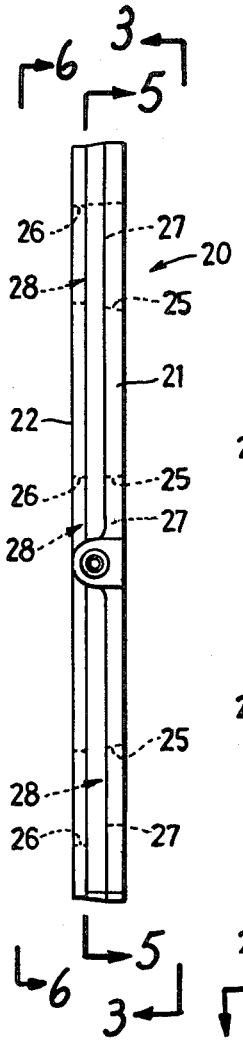
FIG. 2 is a fragmentary side view of a portion of FIG. 1.
Figure 3:
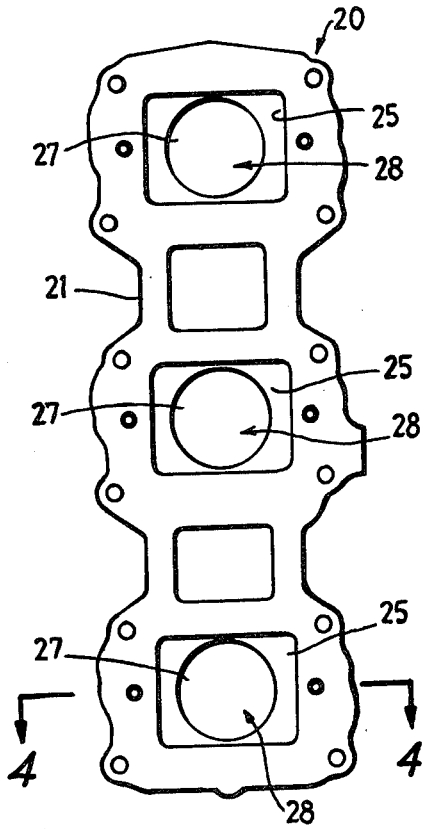
FIG. 3 is a side view of a portion of FIG. 1, taken at line III—III in FIG. 2.
Figure 4:
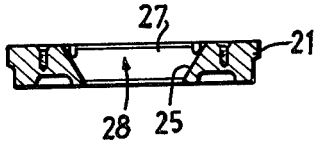
FIG. 4 is a cross-section taken at line IV—IV in FIG. 3.
Figure 5:
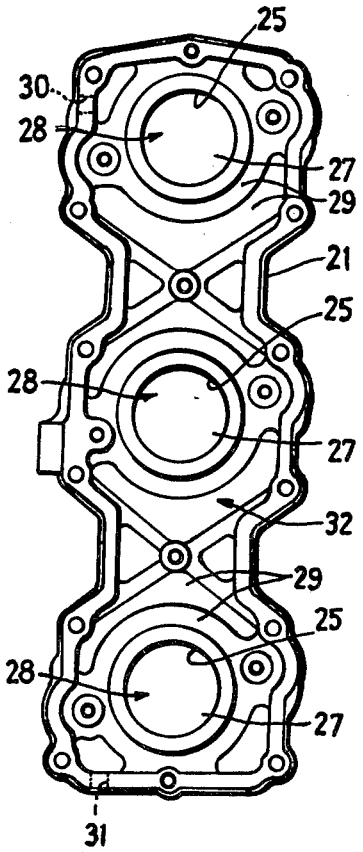
FIG. 5 is a cross-section taken at line V—V in FIG. 2.
Figure 6:
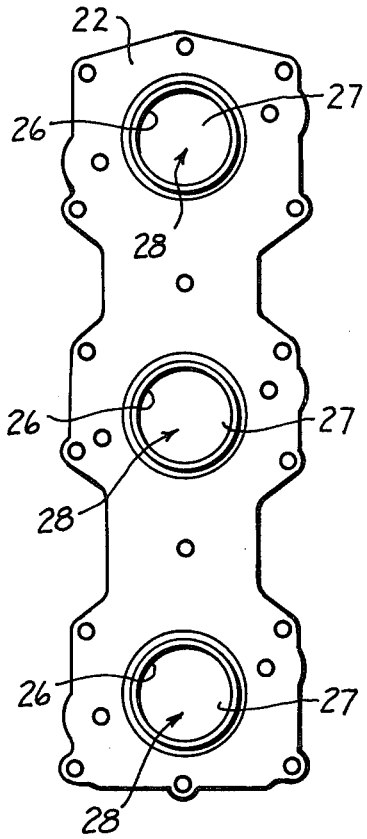
FIG. 6 is a side view taken at line VI—VI in FIG. 2.

An intake passage member 20 according to the present invention is interposed between the aforementioned respective carburetors 15 and passages 13. Intake passage member 20 is constructed, as shown in detail in FIGS. 2 and 6, to have a passage member body 21 and a cover 22 abutting against each other. Passage member body 21 is connected through a gasket 23 to the open ends of passages 13, whereas cover 22 is connected through an O-ring 24 to the intake openings of carburetors 15. Passage member body 21 and cover 22 are formed with holes 25 and holes 26, which respectively communicate with a passage 13 and with a carburetor 15. Holes 25 and 26 are positioned to face each other in an end-to-end relationship so that passage member body 21 and cover 22 abut against each other, thereby to form intake holes 27 so that the intake passage member 20 is formed with three intake passages 28 for providing communication between the three passages 12 and the three carburetors 15.

On the other hand, the abutting face of passage member body 21 against cover 22 is formed with a recess 29 which is inwardly recessed so as to enclose holes 25, and which has its upper and lower ends opened into the side wall of body 21, thereby to form a cooling water inlet 30 and a cooling water outlet 31, respectively. The recess 29 thus formed provides a heating chamber 32 when the cover is brought into an abutting position. Moreover, cooling water inlet 30 communicates with water jacket 17 at the side of cylinder head 16 so that heating chamber 32 is fed with cooling water which has a high temperature because it has cooled cylinders 4, and cylinder head 16. The cooling water thus introduced flows, i.e., circulates from the upper portion to the lower portion of heating chamber 32 until it is discharged to the outside of the outboard engine through cooling water outlet 31.

Incidentally, cooling water inlet and outlet 30 and 31 have their respective effective areas of size such that the aforementioned heating chamber 32 may be filled up with the cooling water, whereby the intake passages 28 of respective cylinders 4 are uniformly heated.

According to the construction thus far described, therefore, intake passages 28 and their vicinities are heated by the cooling water, which acquires a high temperature because it has cooled the cylinders 4 and cylinder head 16, so that the heat is also transferred to the respective carburetors 15 and so on, whereby carburetors 15 and so on themselves are heated.

Since the cooling water at a high temperature circulates in the heating chamber 32, this chamber 32 is uniformly heated as a whole without having any special portion locally heated. As a result, the respective intake passages 28 are substantially uniformly heated to make uniform the mixing ratios of the mixtures to be fed to the respective cylinders so that the dispersion of the charge and its ration, from cylinder to cylinder is made relatively uniform and optimized. Thus, the present invention can suitably be applied to an engine of multi-cylinder and multi-carburetor type, in which individual carburetors 15 are connected to respective cylinders 4.

Figure 7:
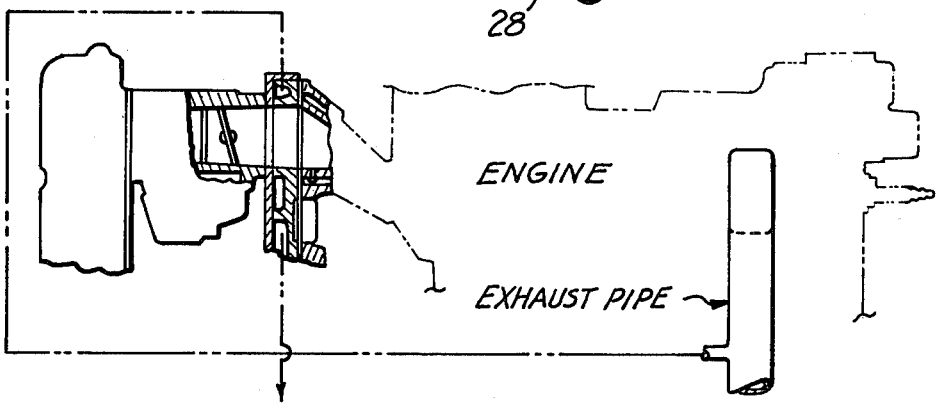
FIGS. 7 and 8 are fragmentary views, partly cutaway cross-section, showing two other embodiments of the invention.

FIG. 7 shows another embodiment, in which the engine exhaust gas is used as the heat medium. According to the second embodiment, the present invention can be applied not only to the water-cooled engine but also an air-cooled engine. It differs from FIG. 1 only in that exhaust gas is circulated in the chamber, rather than a liquid coolant.

Figure 8:
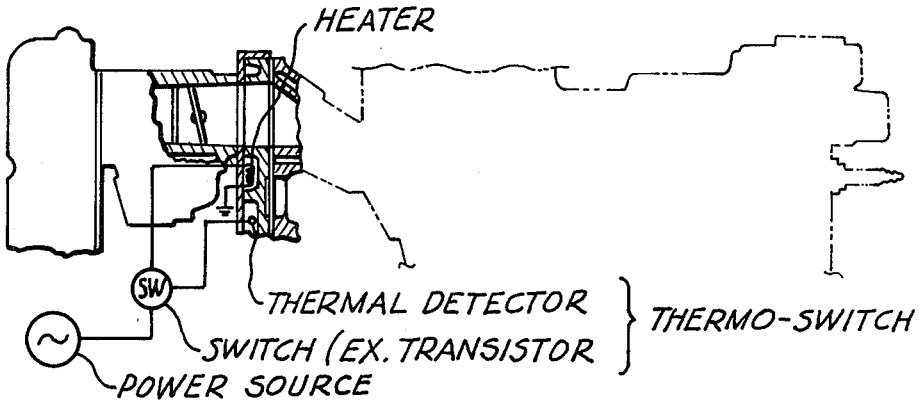

FIG. 8 shows still another embodiment, in which a liquid such as water is confined in the heating chamber and is heated in the chamber by means of a heater. In this third embodiment, the heat generating rate of the heater is controlled by means of a thermo-switch which is operative to detect the temperature of the liquid.

The heat in the intake passage is transferred to the carburetor so that the carburetor can be prevented from icing. In addition, the fuel once atomized can be prevented from being again condensed and separated in the intake passage, while its atomization being promoted, so that the mixture need not be set rich, even when the ambient air is chill, thus reducing the fuel consumption rate.

Although the foregoing description has been upon embodiments which are applied to a two-stroke cycle three-cylinder engine to be used in a marine outboard engine, the present invention is not to be limited to such an outboard engine or application but can be applied to an internal combustion engine for a small snowmobile. Moreover, the present invention can also be practised even if the number of the cylinders is one, two, four or more, and no difficulty is raised even if the present invention is applied to a four-cycle engine, rather than to the two-stroke cycle engine which is shown.

This invention it not to be limited by the embodiments which are shown in the drawings and described in the description, which are given by way of example and not of limitation, but only in accordance with the scope of the appended claims.

We claim:

1. In an internal combustion engine having a cylinder, a carburetor, said carburetor having a heat-conductive metal wall, a throttle in said carburetor, an intake passage for receiving fuel/air mixture from said carburetor and conducting it to said cylinder, said intake passage having a heat-conductive metal wall, means to resist icing of said carburetor and condensation of fuel from said mixture, comprising: heater chamber means surrounding a portion of said intake passage so as to heat said metal wall, said chamber means being adapted to contain fluid at an elevated temperature whereby to heat the inside wall of said intake passage, said metal walls of said carburetor and of said intake passage being physically connected in heat-conductive relationship, whereby heating of said intake passage wall also heats said carburetor wall.

2. Apparatus according to claim 1 in which said engine includes a liquid cooling circuit, and in which said chamber means is connected to said liquid cooling circuit to receive hot coolant to heat said intake passage wall.

3. Apparatus according to claim 1 in which said engine includes an exhaust gas system, and in which said chamber means is connected to said exhaust gas system to receive hot exhaust gases to heat said intake passage wall.

4. Apparatus according to claim 1 in which said chamber means contains heater means to heat liquid therein in order to heat said intake passage wall.

5. Apparatus according to claim 1 in which said chamber means is formed in a plate-like member, said plate-like member being in abutment with portions of said metal wall of said intake passage and of said carburetor, and having a passage therethrough which forms part of said intake passage.

6. Apparatus according to claim 5 in which said engine includes a liquid cooling circuit, and in which said chamber means is connected to said liquid cooling circuit to receive hot coolant to heat said intake passage wall.

7. Apparatus according to claim 5 in which said engine includes an exhaust gas system, and in which said chamber means is connected to said exhaust gas system to receive hot exhaust gases to heat said intake passage wall.

8. Apparatus according to claim 5 in which said chamber means contains heater means to heat liquid therein in order to heat said intake passage wall.

* * * * *